US010316435B2

(12) United States Patent
Xue et al.

(10) Patent No.: US 10,316,435 B2
(45) Date of Patent: Jun. 11, 2019

(54) METHOD AND DEVICE OF DYNAMICALLY CONFIGURING LINEAR DENSITY AND BLENDING RATIO OF YARN BY TWO-INGREDIENT ASYNCHRONOUS/SYNCHRONOUS DRAFTED

(71) Applicant: JIANGNAN UNIVERSITY, Wuxi (CN)

(72) Inventors: Yuan Xue, Wuxi (CN); Weidong Gao, Wuxi (CN); Mingrui Guo, Wuxi (CN); Jian Zhou, Wuxi (CN); Ruihua Yang, Wuxi (CN); Hongbo Wang, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 293 days.

(21) Appl. No.: 15/309,802

(22) PCT Filed: Jul. 28, 2015

(86) PCT No.: PCT/CN2015/085266

§ 371 (c)(1),
(2) Date: Nov. 9, 2016

(87) PCT Pub. No.: WO2016/155164

PCT Pub. Date: Oct. 6, 2016

(65) Prior Publication Data

US 2017/0268134 A1 Sep. 21, 2017

(30) Foreign Application Priority Data

Mar. 27, 2015 (CN) ..... 2015 1 0140954
Mar. 27, 2015 (CN) ..... 2015 1 0142417
Mar. 27, 2015 (CN) ..... 2015 1 0142418

(51) Int. Cl.
*D01H 5/36* (2006.01)
*D01H 5/44* (2006.01)
*D01H 5/74* (2006.01)

(52) U.S. Cl.
CPC ..... *D01H 5/36* (2013.01); *D01H 5/44* (2013.01); *D01H 5/74* (2013.01)

(58) Field of Classification Search
CPC .. D01H 5/22; D01H 5/32; D01H 5/36; D01H 5/74–5/82
See application file for complete search history.

(56) References Cited

U.S. PATENT DOCUMENTS 46,896 A * 3/1865 Goodspeed ..... B65H 27/00 492/39
2,198,279 A * 4/1940 Weinberger ..... D01H 5/74 19/258

(Continued)

FOREIGN PATENT DOCUMENTS

CN 1336453 A 2/2002
CN 102031600 A 4/2011

(Continued)

*Primary Examiner* — Shaun R Hurley
(74) *Attorney, Agent, or Firm* — Gokalp Bayramoglu

(57) ABSTRACT

The invention discloses a method of dynamically configuring linear density and blending ratio of yarn by two-ingredient asynchronous/synchronous drafted, comprising: a drafting and twisting system, which includes a first stage drafting unit, a successive second stage drafting unit and an integrating and twisting unit. The first stage drafting unit includes a combination of back rollers and a middle roller. The second stage drafting unit includes a front roller and the middle roller. Blending proportion and linear densities of the two ingredients are dynamically adjusted by the first stage asynchronous drafting mechanism, and reference linear density is adjusted by the second stage synchronous drafting mechanism. The invention can not only accurately control (Continued)

linear density change, but also accurately control color change of the yarn. Further, the rotation rate of the middle roller is constant, ensuring a reproducibility of the patterns and colors of the yarn with a changing linear density.

14 Claims, 3 Drawing Sheets

(56) References Cited

U.S. PATENT DOCUMENTS 2,991,514 A * 7/1961 Cotchett ..... D01H 5/76 19/295
3,020,697 A * 2/1962 Henry ..... D02G 3/346 19/288
3,599,305 A * 8/1971 Aurich ..... H01H 36/00 100/917
5,161,284 A * 11/1992 Leifeld ..... D01H 1/22 19/243
5,343,598 A * 9/1994 Hauner ..... D01G 15/46 19/150
5,774,943 A * 7/1998 Clapp ..... D01H 5/46 19/240
5,796,220 A * 8/1998 Clapp ..... D01H 5/42 19/157
6,021,548 A * 2/2000 Temburg ..... D01H 13/04 19/150
6,182,333 B1 * 2/2001 Lauhus ..... D01H 5/80 19/236
6,289,599 B1 * 9/2001 Leifeld ..... B65H 63/062 19/23
2017/0051439 A1 * 2/2017 Gao ..... D01H 5/36
2017/0067188 A1 * 3/2017 Xue ..... D01H 5/22
2017/0073849 A1 * 3/2017 Gao ..... D01H 5/36

FOREIGN PATENT DOCUMENTS

CN 102995174 A 3/2013
CN 203795057 U 8/2014
CN 104711730 A 6/2015
CN 104726976 A 6/2015
CN 104762714 A 7/2015
CN 204530068 U 8/2015
WO WO2015033811 A1 3/2015

* cited by examiner

METHOD AND DEVICE OF DYNAMICALLY CONFIGURING LINEAR DENSITY AND BLENDING RATIO OF YARN BY TWO-INGREDIENT ASYNCHRONOUS/SYNCHRONOUS DRAFTED

CROSS REFERENCE TO RELATED APPLICATIONS

This application is a national phase entry application of International Application NO. PCT/CN2015/085266, file on Jul. 28, 2015, which is based upon and claims priority to NO. CN201510142417.6, file on Mar. 27, 2015, claims another priority to NO. CN201510140954.7, file on Mar. 27, 2015, and claims a third priority to NO. CN201510142418.0, file on Mar. 27, 2015, the entire contents of which are incorporated herein by reference.

TECHNICAL FIELD

The invention relates to a ring spinning filed of a textile industry, and particularly relates to a method and device of dynamically configuring linear density and blending ratio of yarn by two-ingredient asynchronous drafted.

BACKGROUND

Yarn is a long and thin fiber assembly formed by orienting in parallel and twisting of fiber. The characteristic parameters generally include fineness (linear density), twist, blending ratio (color blending ratio), etc. The characteristic parameters are important features which should be controlled during a forming process.

The yarn can be divided into four categories:

(1) yarn with a constant linear density and a variable blending ratio, such as a color yarn of constant liner density, with a gradient or segmented color;

(2) yarn with a constant blending ratio and variable linear density, such as a slub yarn, a dotted yarn, etc.;

(3) yarn with a variable linear density and blending ratio, such as segmented a color slub yarn, a segmented color dotted yarn, etc.;

(4) blended yarn or mixed color yarn mixed at any rate, with a constant linear density and blending ratio.

The development of yarn processing technology mainly relates to the problems of special yarns. The existing spinning technology and the patent applications fail to guide the spinning production of the above four types of yarns, challenging the existing spinning theories. Specifically, it is analyzed as follows:

(1) Yarn with a Constant Linear Density and a Variable Blending Ratio (Color Blending Ratio)

The yarn with a constant linear density and a variable blending ratio (color blending ratio) can be assumed as a color yarn of constant liner density, with a gradient or segmented color. No existing patent application is related to this type of yarn.

(2) Yarn with a Constant Blending Ratio and Variable Linear Density

The yarn with a constant blending ratio and variable linear density, can be such as a slub yarn, a dotted yarn, etc. The existing method of manufacturing the ring spun yarn with a variable linear density comprises feeding one roving yarn each to the middle roller and back roller, and discontinuously spinning to manufacture the yarns with variable linear density by uneven feeding from the back roller. For example, a patent entitled "a discontinuous spinning process and yarns thereof" (ZL01126398.9), comprising: feeding an auxiliary fiber strand B from the back roller; unevenly drafting it via the middle roller and back roller; integrating with another main fiber strand fed from the middle roller, and entering into the drafting area; drafting them by the front roller and middle roller, and outputting from the jaw of the front roller; entering into the twisting area to be twisted and form yarns. Because the auxiliary fiber strand is fed from the back roller intermittently and integrates with the main fiber strand, under the influence of the front area main drafting ratio, the main fiber strand is evenly attenuated to a certain linear density, and the auxiliary fiber strand is attached to the main fiber strand to form a discontinuous and uneven linear density distribution. By controlling the fluctuation quantity of the uneven feeding from the back roller, different effects such as a dotted yarn, a slub yarn, etc. are obtained finally on the yarn. The deficiencies of this method are that the main and auxiliary fiber strands cannot be exchanged and a range of slub thickness is limited.

(3) Yarn with a Variable Linear Density and Blending Ratio

No existing patent application relates to this type of yarn.

(4) Blended Yarn or Mixed Color Yarn Mixed at any Rate, with a Constant Linear Density and Blending Ratio The blended yarn or mixed color yarn mixed/blended at any rate should be produced with a constant linear density and blending ratio. The current method comprises blending two or more than two different ingredients to obtain a roving yarn at a certain blending ratio such as 50:50, 65:35, 60:40, by fore-spinning process, then spinning the roving yarn to form a spun yarn by spinning process to obtain a yarn with a constant linear density and a blending ratio. The deficiencies are that they cannot be blended at any rate and two or more than two fibers cannot be blended at any rate in a single step.

SUMMARY OF THE INVENTION

To solve the above problems, the objective of this invention is to disclose a process of providing two-ingredient asynchronous/synchronous two-stage drafting fiber strands, and then integrating and twisting to form a yarn. The linear density and blending ratio of ring spun yarn can be adjusted arbitrarily. The invention can adjust the linear density and blending ratio of the yarn at the same time to produce the above four types of yarns, overcoming the limitation of being unable to adjust characteristic parameters of a yarn on line.

To achieve the above objectives, the invention discloses a method of dynamically configuring linear density and blending ratio of yarn by two-ingredient asynchronous drafting, comprising:

1) An actuating mechanism mainly includes a two-ingredient asynchronous/synchronous two-stage drafting mechanism, a twisting mechanism and a winding mechanism. The two-ingredient asynchronous/synchronous two-stage drafting mechanism includes a first stage asynchronous drafting unit and a successive second stage synchronous drafting unit;

2) The first stage asynchronous drafting unit includes a combination of back rollers and a middle roller. The combination of back rollers has two rotational degrees of freedom and includes a first back roller, a second back roller, which are set abreast on a same back roller shaft. The first back roller, the second back roller move at the speeds $V_{h1}$, $V_{h2}$ respectively. The middle roller rotates at the speed $V_z$.

The second stage synchronous drafting unit includes a front roller and the middle roller. The front roller rotates at the surface linear speed $V_q$. Assuming the linear densities of a first roving yarn ingredient, a second roving yarn ingredient, drafted by the first back roller, the second back roller are respectively $\rho_1$, $\rho_2$, the linear density of the yarn Y drafted and twisted by the front roller is $\rho_y$.

$$\rho_y = \frac{1}{V_q}(V_{h1} * \rho_1 + V_{h2} * \rho_2) \tag{1}$$

The blending ratios of the first roving yarn ingredient, the second roving yarn ingredient are respectively $k_1$, $k_2$.

$$K = \frac{k_1}{k_2} = \frac{\rho_1 V_{h1}}{\rho_2 V_{h2}}$$

4) Keeping the ratio of linear speeds of the front roller and the middle roller $V_q/V_z$ constant, the speeds of the front roller and the middle roller depend on reference linear density of the yarn;

5) According to the changes of the blending ratio K of the yarn Y with time t, and the changes of the linear density $\rho_y$ of the yarn Y with the time t, the changes of the surface linear speeds of the first back roller, the second back roller, are derived. Further, the linear density of yarn Y or/and blending ratio can be dynamically adjusted on line, by adjusting the rotation rates of the first back roller, the second back roller.

Wherein, surface linear speeds of the first back roller $V_{h1}$:

$$V_{h1} = \frac{\rho_y K}{\rho_1 V_q (1 + K)}$$

surface linear speeds of the second back roller $V_{h2}$:

$$V_{h2} = \frac{\rho_y}{\rho_2 V_q (1 + K)}$$

Further, the colors of a first roving yarn ingredient, a second roving yarn ingredient, drafted by the first back roller, the second back roller are respectively two of yellow, magenta, cyan, and black respectively.

Further, let $\rho_1=\rho_2=\rho$, and $V_{h1}+V_{h2}=V_z$, linear density of yarn Y is constant, then the blending ratios of the first roving yarn ingredient, the second roving yarn ingredient are set respectively as $k_1$, $k_2$:

$$k_1 = \frac{V_{h1}}{V_{h1} + V_{h2}} = \frac{V_{h1}}{V_z}$$

$$k_2 = \frac{V_{h2}}{V_{h1} + V_{h2}} = \frac{V_{h2}}{V_z}.$$

Further, let $\rho_1=\rho_2=\rho$, by adjusting the linear speed of the first back roller, the second back roller, it can be got that: $V_{h1} \rightarrow V_{h1}+\Delta V_{h1}$, $V_{h2} \rightarrow V_{h2}\Delta V_{h2}$ wherein $\Delta V_{h1}$ is the speed change of the first back roller, and $\Delta V_{h2}$ is the speed change of the second back roller.

Then the linear density of yarn Y is:

$$\rho_y = \frac{\rho}{V_q}[(V_{h1} + V_{h2}) + (\Delta V_{h1} + \Delta V_{h2})],$$

And the blending ratios of the first roving ingredient, the second roving yarn $k_1$, $k_2$ respectively are:

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}}$$

Wherein $k_1+k_2=1$;

Therefore linear density $\rho_y$ of the yarn Y and blending ratios $k_1$, $k_2$ can be changed by changing $\Delta V_{h1}$ and $\Delta V_{h2}$ respectively.

wherein increases in linear velocity of the first roller and the second roller $\Delta V_{h1}$, $\Delta V_{h2}$ are determined from the set linear density and the blend ratio so that the linear density and the blending ratio of the spun yarn satisfy the predetermined requirements Further, Specific adjustment methods are as follows:

1) change the speed of the first back roller $V_{h1}$, and keep the speeds of the second backer rollers unchanged. The yarn ingredient and the linear density thereof of the yarn Y drafted by this back roller change accordingly. The linear density $\rho_y'$ of the yarn Y and blending ratio are adjusted as:

$$\rho_y' = \rho_y + \Delta\rho_y = \frac{1}{e_q} * \frac{\rho}{V_z} * [V_{h2} + (V_{h1} + \Delta V_{h1})]$$

$$k_1 = \frac{V_{h1} + \Delta V_{h1}}{V_{h1} + V_{h2} + \Delta V_{h1}}$$

$$k_2 = \frac{V_{h2}}{V_{h1} + V_{h2} + \Delta V_{h1}}$$

wherein $e_q$ is the two-stage drafting ratio, $V_z$ is the linear speed of middle roller, $\rho$ is the linear density of roving, $\Delta\rho_y$ is linear density change of the yarn.

2) change the speeds of the second back roller $V_{h2}$ and keep the speeds of the first back rollers $V_{h1}$ unchanged. The yarn ingredient and linear densities thereof change accordingly. The linear density $\rho'_y$ of yarn Y and blending ratio are adjusted as:

$$\rho_y' = \rho_y + \Delta\rho_y = \frac{1}{e_q} * \frac{\rho}{V_z} * [V_{h1} + V_{h2} + \Delta V_{h2}]$$

$$k_1 = \frac{V_{h1}}{V_{h1} + V_{h2} + \Delta V_{h2}}$$

$$k_2 = \frac{V_{h2} + \Delta V_{h2}}{V_{h1} + V_{h2} + \Delta V_{h2}};$$

3) change the speeds of the first back roller, the second back roller simultaneously, and the speeds of the two back rollers are unequal to zero respectively. The yarn ingredients of the yarn Y drafted by these two back rollers and the linear densities thereof change accordingly. The linear density $\rho_y'$ of the yarn Y and blending ratio are adjusted as:

$$\rho_y' = \rho_y + \Delta\rho_y = \frac{\rho}{V_q} * [(V_{h1} + \Delta V_{h1}) + (V_{h2} + \Delta V_{h2})]$$

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}};$$

4) change the speeds of the first back roller, the second back roller simultaneously, and make the speeds of one back rollers equal to zero, while the speeds of the other one backer rollers unequal to zero. The yarn ingredients of the yarn Y drafted by the one back rollers is thus discontinuous, while the other yarn ingredients is continuous.

Further, change the speeds of the first back roller, the second back roller, successively at successive time point $T_1$, $T_2$, $T_3$, $T_4$, $T_5$, make the speeds of one back rollers equal to zero, while the speeds of the other one backer rollers unequal to zero, then linear density $\rho_y'$ of the yarn Y and blending ratio are adjusted as:

(1) when $T_1 \leq t \leq T_2$, $$\rho_y' = \rho_y + \Delta\rho_y = \frac{\rho}{V_q} * [(V_{h1} + \Delta V_{h1}) + (V_{h2} + \Delta V_{h2})]$$

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}}$$

(2) when $T_2 \leq t \leq T_3$ $$\rho_y' = \rho_y + \Delta\rho_y = \frac{\rho}{V_q} * (V_{h2} + \Delta V_{h2})$$

$$k_1 = 0$$

$$k_2 = 1$$

(3) when $T_3 \leq t \leq T_4$ $$\rho_y' = \rho_y + \Delta\rho_y = \frac{\rho}{V_q} * [(V_{h1} + \Delta V_{h1}) + (V_{h2} + \Delta V_{h2})]$$

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}}$$

(4) when $T_4 \leq t \leq T_5$ $$\rho_y' = \rho_y + \Delta\rho_y = \frac{\rho}{V_q} * (V_{h2} + \Delta V_{h2})$$

$$k_1 = 1$$

$$k_2 = 0.$$

Further, according to the set blending ratio and/or linear density, divide the yarn Y into n segments. The linear density and blending ratio of each segment of the yarn Y are the same, while the linear densities and blending ratios of the adjacent segments are different. When drafting the segment i of the yarn Y, the linear speeds of the first back roller, the second back roller are $V_{h1i}$, $V_{h2i}$, wherein $i \in (1, 2, \ldots, n)$; The first roving ingredient, the second roving ingredient, are two-stage drafted and twisted to form segment i of the yarn Y, and the blending ratios $k_{1i}$, $k_{2i}$ thereof are expressed as below:

$$k_{1i} = \frac{\rho_1 * V_{h1i}}{\rho_1 * V_{h1i} + \rho_2 * V_{h2i}} \tag{2}$$

$$k_{2i} = \frac{\rho_2 * V_{h2i}}{\rho_1 * V_{h1i} + \rho_2 * V_{h2i}} \tag{3}$$

the linear density of segment i of yarn Y is:

$$\rho_{yi} = \frac{V_Z}{V_q} * \left(\frac{V_{h1i}}{V_Z} * \rho_1 + \frac{V_{h2i}}{V_Z}\rho_2\right) = \frac{1}{e_q} * \left(\frac{V_{h1i}}{V_Z} * \rho_1 + \frac{V_{h2i}}{V_Z}\rho_2\right) \tag{4}$$

wherein $$e_q = \frac{V_q}{V_z}$$

is the two-stage drafting ratio;

Take the segment with the lowest density as a reference segment, whose reference linear density is $\rho_0$. The reference linear speeds of the first back roller, the second back roller, for this segment are respectively $V_{h10}$, $V_{h20}$; and the reference blending ratios of the first roving yarn ingredient, the second roving yarn ingredient, for this segment are respectively $k_{10}$, $k_{20}$, Keep the linear speed of the middle roller constant, and $$V_z = V_{h10} + V_{h20} \tag{5}$$

also keep two-stage drafting ratio $$e_q = \frac{V_q}{V_z}$$

constant;

wherein the reference linear speeds of the first back roller, the second back roller for this segment are respectively $V_{h10}$, $V_{h20}$, which can be predetermined according to the material, reference linear density $\rho_0$ and reference blending ratios $k_{10}$, $k_{20}$ of the first roving ingredient, the second roving ingredient.

When the segment i of the yarn Y is drafted and blended, on the premise of known set linear density $\rho_{yi}$ and blending ratios $k_{1i}$, $k_{2i}$, the linear speeds $V_{h1i}$, $V_{h2i}$, of the first back roller, the second back roller are calculated according to Equations (2)-(5);

Based on the reference linear speeds $V_{h10}$, $V_{h20}$ for the reference segment, increase or decrease the rotation rates of the first back roller, or/and the second back roller to dynamically adjust the linear density or/and blending ratio for the segment i of the yarn Y.

Further, let $\rho_1 = \rho_2 = \rho$, the Equation (4) can be simplified as $$\rho_{yi} = \frac{\rho}{e_q} * \frac{V_{h1i} + V_{h2i}}{V_Z}. \tag{6}$$

According to Equations (2), (3), (5) and (6), the linear speeds $V_{h1i}$, $V_{h2i}$ of the first back roller, the second back roller are calculated; based on the reference linear speeds $V_{h10}$, $V_{h20}$, the rotation rates of the first back roller, or/and the second back roller are increased or decreased to reach the preset linear density and blending ratio for the segment i of yarn Y.

Further, at the moment of switching the segment i−1 to the segment i of yarn Y, let the linear density of the yarn Y increase by dynamic increment $\Delta\rho_{yi}$, i.e., thickness change $\Delta\rho_{yi}$, on the basis of reference linear density; and thus the first back roller, the second back roller have corresponding increments on the basis of the reference linear speed, i.e., when $(V_{h10}+V_{h20})\rightarrow(V_{h10}+\Delta V_{h1i}+V_{h20}\Delta V_{h2i})$, the linear density increment of yarn Y is:

$$\Delta\rho_{yi} = \frac{\rho}{e_q * V_Z} * (\Delta V_{h1i} + \Delta V_{h2i});$$

Then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i}}{V_Z} * \frac{\rho}{e_q}. \quad (7)$$

Let $\Delta V_1=\Delta V_{h1i}+\Delta V_{h2i}$.

Then Equation (7) is simplified as:

$$\rho_{yi} = \rho_{y0} + \frac{\Delta V_i}{V_Z} * \frac{\rho}{e_q}. \quad (8)$$

The linear density of yarn Y can be adjusted by controlling the sum of the linear speed increments ΔVi of the first back roller, the second back roller.

Further, let $\rho_1=\rho_2=\rho$, at the moment of switching the segment i−1 to the segment i of the yarn Y, the blending ratios of the yarn Yin Equations (2)-(3) can be simplified as:

$$k_{1i} = \frac{V_{h10} + \Delta V_{h1i}}{V_Z + \Delta V_i} \quad (9)$$

$$k_{2i} = \frac{V_{h20} + \Delta V_{h2i}}{V_Z + \Delta V_i} \quad (10)$$

The blending ratios of the yarn Y can be adjusted by controlling the linear speed increments of the first back roller, the second back roller;

wherein $$\Delta V_{h1i}=k_{1i}*(V_Z+\Delta V_i)-V_{h10}$$

$$\Delta V_{h2i}=k_{2i}*(V_Z+\Delta V_i)-V_{h20}.$$

Further, let $V_{h1i}*\rho_1+V_{h2i}*\rho_2=H$ and H is a constant, then ΔVi is constantly equal to zero, and thus the linear density is unchanged when the blending ratios of the yarn Y are adjusted.

Further, let any one of $\Delta V_{h1i}$, $\Delta V_{h2i}$ be equal to zero, while the remaining one is not zero, then the one roving yarn ingredients can be changed while the other roving yarn ingredients is unchanged. The adjusted blending ratios are:

$$k_{1i} = \frac{V_{h10} + \Delta V_{h1i}}{V_Z + \Delta V_{h1i}}$$

$$k_{2i} = \frac{V_{h20}}{V_Z + \Delta V_{h1i}} \text{ or}$$

$$k_{1i} = \frac{V_{h10}}{V_Z + \Delta V_{h2i}}$$

$$k_{2i} = \frac{V_{h20} + \Delta V_{h2i}}{V_Z + \Delta V_{h2i}}.$$

Further, let none of $\Delta V_{h1i}$, $\Delta V_{h2i}$ be equal to zero, then the proportion of the two roving yarn ingredients in the yarn Y may be changed. The adjusted blending ratios are:

$$k_{1i} = \frac{V_{h10} + \Delta V_{h1i}}{V_Z + \Delta V_i}$$

$$k_{2i} = \frac{V_{h20} + \Delta V_{h2i}}{V_Z + \Delta V_i}.$$

Further, let one of $\Delta V_{h1i}$, $\Delta V_{h2i}$ be equal to zero, while the remaining one is not zero, then the one roving yarn ingredients of the segment i of the yarn Y may be discontinuous, thus yarn Y only has one roving ingredient.

A device for configuring a linear density and a blending ratio of a yarn by two-ingredient asynchronous/synchronous drafting, comprises a control system and an actuating mechanism. The actuating mechanism includes two-ingredient asynchronous/synchronous two-stage drafting mechanism, a twisting mechanism and a winding mechanism. The two-stage drafting mechanism includes a first stage drafting unit and a second stage drafting unit; the first stage drafting unit includes a combination of back rollers and a middle roller. The combination of back rollers has two rotational degrees of freedom and includes a first back roller, a second back roller, which are set abreast on a same back roller shaft. The second stage drafting unit includes a front roller and the middle roller.

Further, the control system mainly includes a PLC programmable controller, a servo driver, a servo motor, etc.

Further, the first back roller is fixedly set on the back roller shaft. The second roller is rotatably set on the back roller shaft.

The dotted yarn, slub yarn and mixed color yarn produced by the method and device of the invention are more even and accurate in color mixing. Further, by controlling speeds of the two back rollers, the stable blending effect is ensured. The color difference of the yarn from different batches is not obvious. The contrast about technical effects between the invention and the prior art is showed in the following table.

TABLE 1

The contrast about technical effects between the invention and the prior art

| | Dot yarn pattern errors (/100 m) | Slub yarn linear density adjustment error rate | Linear density adjustment error rate | Color-blending evenness |
|---|---|---|---|---|
| prior art | 7-8 | 10-12% | 11-13% | level 2-3 |
| the invention | 1-2 | 1-3% | 1-3% | level 1 |

Therefore, the invention is very effective.

The method of the invention changes the traditional five-ingredient front and back areas synchronous drafting to two-ingredient separate asynchronous drafting (referred to as first stage asynchronous drafting) and two-ingredient integrated synchronous drafting (referred to as second stage synchronous drafting). The blending proportion of the two ingredients and linear density of the yarn are dynamically adjusted by the first stage separate asynchronous drafting, and the reference linear density of the yarn is adjusted by the second stage synchronous drafting. The linear density and the blending ratio of the yarn can be dynamically adjusted online by the two-ingredient separate/integrated asynchronous/synchronous two-stage drafting, combined with the spinning device and process of the twisting, which breaks through the three bottlenecks existing in the slub yarn spinning process of the prior art. The three bottlenecks are: 1. only the linear density can be adjusted while the blending ratio (color change) cannot be adjusted; 2. monotonous pattern of the slub yarn; 3. poor reproducibility of the slub yarn pattern.

Calculations for the Processing Parameters of Two-Ingredient Separate/Integrated Asynchronous/Synchronous Two-Stage Drafting Coaxial Twisting Spinning System According to the drafting theory, the drafting ratio of the first stage drafting is:

$$e_{h1} = \frac{V_Z}{V_{h1}} = \frac{\rho_1}{\rho_1'} \tag{11}$$

$$e_{h2} = \frac{V_Z}{V_{h2}} = \frac{\rho_2}{\rho_2'} \tag{12}$$

After the first stage drafted, the linear density of the first roving and second roving are $\rho_1'$ and $\rho_2'$ respectively.

The equivalent drafting ratio of the first stage drafting is:

$$\bar{e}_h = \frac{\rho_1 + \rho_2}{\rho_1' + \rho_2'} \tag{13}$$

The drafting ratio of the second stage drafting is:

$$e_q = \frac{V_q}{V_Z} = \frac{\rho_1'}{\rho_1''} = \frac{\rho_2'}{\rho_2''} = \frac{\rho_1' + \rho_2'}{\rho_1'' + \rho_2''} \tag{14}$$

After the second stage drafted, the linear density of the first roving and second roving are $\rho_1''$ and $\rho_2''$ respectively.

The total equivalent drafting ratio $\bar{e}$ is:

$$\bar{e} = \frac{\rho_1 + \rho_2}{\rho_1'' + \rho_2''} = \bar{e}_h * e_q \tag{15}$$

The total equivalent drafting ratio $\bar{e}$ is a significant parameter in the spinning process, which is the product of front area drafting ratio and back area drafting ratio.

According to the established spinning model of the invention, the two roving yarns are asynchronously drafted in the back area and synchronously drafted in the front area and then are integrated and twisted to form a yarn, the blending ratios thereof $k_1$, $k_2$ can be expressed as follows:

$$k_1 = \frac{\rho_1''}{\rho_1'' + \rho_2''} = \frac{\rho_1'}{\rho_1' + \rho_2'} = \frac{\rho_1 * V_{h1}}{\rho_1 * V_{h1} + \rho_2 * V_{h2}} \tag{16}$$

-continued $$k_2 = \frac{\rho_2''}{\rho_1'' + \rho_2''} = \frac{\rho_2'}{\rho_1' + \rho_2'} = \frac{\rho_2 * V_{h2}}{\rho_1 * V_{h1} + \rho_2 * V_{h2}} \tag{17}$$

As known from the Equations (16), (17) the blending ratios of the two ingredients in the yarn is related to the surface rotation rates $V_{h1}$, $V_{h2}$ of the back rollers and the linear densities $\rho_1$, $\rho_2$ of the two roving yarns. Generally, $\rho_1$ and $\rho_2$ are constant and irrelevant to the time, while $V_{h1}$, $V_{h2}$ are related to the speed of the main shaft. Because the main shaft speed has a bearing on the spinner production, different main shaft speeds are adopted for different materials and product specifications in different enterprises. As such, even though $\rho_1$, $\rho_2$ of the roving yarns are constant, the blending ratios determined by Equations (16), (17) change due to the speed change of the main shaft, which results in the changes of $V_{h1}$, $V_{h2}$, rendering the blending ratios uncertain.

In the same way, the two roving yarns are two-stage drafted, integrated and twisted to form a yarn with the following linear density:

$$\rho_y = \frac{\rho_1 + \rho_2}{\bar{e}} = \rho_1'' + \rho_2'' = \frac{V_z}{V_q} * \rho_1' + \frac{V_z}{V_q} * \rho_2' = \frac{V_z}{V_q} * \frac{V_{h1}}{V_z} * \rho_1 + \frac{V_z}{V_q} * \frac{V_{h2}}{V_z} \rho_2$$

and then the linear density of the yarn is:

$$\rho_y = \frac{1}{V_q}(V_{h1} * \rho_1 + V_{h2} * \rho_2) \tag{18}$$

As known from Equation (18), the linear density of the yarn is related to the speed $V_{h1}$, $V_{h2}$ of the combination of back rollers and the linear densities $\rho_1$, $\rho_2$ of the two roving yarns. Generally, $\rho_1$, $\rho_2$ are constant and irrelevant to the time while $V_{h1}$, $V_{h2}$ are related to the main shaft speed set by the spinning machine. Because the main shaft speed has a bearing on the production of the spinning machine, different main shaft speeds would be adopted when spinning the different materials with different product specifications in different enterprises. As such, for the linear density determined by Equation (18), even though $\rho_1$, $\rho_2$ of the two roving yarns remain unchanged, $V_{h1}$, $V_{h2}$ would change with the main shaft speed, rendering the linear density uncertain.

From Equation (11):

$$\rho_1' = \frac{V_{h1}}{V_Z} * \rho_1$$

From Equation (12):

$$\rho_2' = \frac{V_{h2}}{V_Z} * \rho_2 \therefore \rho_1' + \rho_2' = \frac{\rho_1 * V_{h1} + \rho_2 * V_{h2}}{V_Z} \tag{19}$$

Equation (19) is substituted in Equation (3) and then solved for the equivalent drafting ratio $\bar{e}_h$:

$$\bar{e}_h = \frac{\rho_1 + \rho_2}{\rho_1 * V_{h1} + \rho_2 * V_{h2}} * V_Z \tag{20}$$

Equation (20) is substituted in Equation (15) and then solved for the total equivalent drafting ratio $\bar{e}$:

$$\bar{e} = \frac{\rho_1 + \rho_2}{\rho_1 * V_{h1} + \rho_2 * V_{h2}} * V_Z * \frac{V_q}{V_Z} = \frac{\rho_1 + \rho_2}{\rho_1 * V_{h1} + \rho_2 * V_{h2}} * V_q \quad (21)$$

To negate the changes caused by the different main shaft speeds, the limited condition is provided as follows:

$$\rho_1 = \rho_2 = \rho \quad (22)$$

Equation (22) is substituted in Equation (19):

$$\rho_1' + \rho_2' = \rho * \frac{(V_{h1} + V_{h2})}{V_z} \quad (23)$$

Equations (22), (23) are substituted in Equation (20):

$$\bar{e}_h = \frac{V_Z}{\frac{(V_{h1} + V_{h2})}{2}} \quad (24)$$

$$\bar{e} = \bar{e}_h * e_q = \frac{V_q}{\frac{(V_{h1} + V_{h2})}{2}} \quad (25)$$

Equations (22), (23), (24) are substituted in Equations (16), (17):

$$k_1 = \frac{V_{h1}}{V_{h1} + V_{h2}} = \frac{V_z}{V_{h1} + V_{h2}} * \frac{1}{e_{h1}} \quad (27)$$

$$k_2 = \frac{V_{h2}}{V_{h1} + V_{h2}} = \frac{V_z}{V_{h1} + V_{h2}} * \frac{1}{e_{h2}} \quad (28)$$

Further in a special condition, $V_{h1}+V_{h2}=V_Z$ i.e., the sum of the speeds of the two back rollers is equal to the linear speed of the middle roller, then the above two equations can be further simplified as:

$$k_1 = \frac{V_{h1}}{V_Z} = \frac{1}{e_{h1}}$$

$$k_2 = \frac{V_{h2}}{V_Z} = \frac{1}{e_{h2}}$$

The blending ratios of the two ingredients $\rho_1$, $\rho_2$ in the yarn are equal to the inverses of their respective drafting ratios.

$$e_{h1} = \frac{V_Z}{V_{h1}} = \frac{1}{k_1}$$

-continued $$e_{h2} = \frac{V_Z}{V_{h2}} = \frac{1}{k_2}$$

Assuming:

$k_1$=0, 0.1, 0.2, 0.3, 0.4, 0.5, 0.6, 0.7, 0.8, 0.9, 1

$k_2$=1, 0.9, 0.8, 0.7, 0.6, 0.5, 0.4, 0.3, 0.2, 0.1, 0

$e_{h1}$,$e_{h2}$ can be calculated as listed by Table 2.

TABLE 2

| Blending ratio and first-stage drafting | | | | | | | | | | | |
|---|---|---|---|---|---|---|---|---|---|---|---|
| $k_1$ | 0 | 0.1 | 0.2 | 0.3 | 0.4 | 0.5 | 0.6 | 0.7 | 0.8 | 0.9 | 1 |
| $e_{h1}$ | | 10 | 5 | 10/3 | 10/4 | 10/5 | 10/6 | 10/7 | 10/8 | 10/9 | 1 |
| $k_2$ | 1 | 0.9 | 0.8 | 0.7 | 0.6 | 0.5 | 0.4 | 0.3 | 0.2 | 0.1 | 0 |
| $e_{h2}$ | 1 | 10/9 | 10/8 | 10/7 | 10/6 | 10/5 | 10/4 | 10/3 | 5 | 10 | |

The color mixing ratios can be gradiently configured to get different color schemes.

Under the condition that $V_{h1}+V_{h2}$ is unchanged, blending ratios of yarn with different ingredient or color can be achieved.

Let $k_1$, $k_2$ change within the range of 0-100%, the color mixing ratio increases at least at the rate of 10%, the color mixing and matching schemes are provides as below:

TABLE 3

| Color scheme | | | | |
|---|---|---|---|---|
| | | Color A Ratio K1 | Color B Ratio K2 | No. |
| Single Color | A | 1 | 0 | 1 |
| | B | 0 | 1 | 2 |
| Blended By Double Colors | AB | 0.1 | 0.9 | 3 |
| | | 0.2 | 0.8 | 4 |
| | | 0.3 | 0.7 | 5 |
| | | 0.4 | 0.6 | 6 |
| | | 0.5 | 0.5 | 7 |
| | | 0.6 | 0.4 | 8 |
| | | 0.7 | 0.3 | 9 |
| | | 0.8 | 0.2 | 10 |
| | | 0.9 | 0.1 | 11 |

There can be countless combinations with $k_1+k_2$=100%. By coupling and drafting, interactive discolour, gradient color matching, and blending and twisting from the ring spinning frame-drafting-twisting system, 11 different color yarns can be got and also 11 periods of color yarn as showed by Table 3.

The blended yarn or mixed color yarn mixed/blended can be produced with a constant linear density and blending ratio. The current ring spun yarn process comprises blending two or more than two different ingredients to obtain a roving yarn at a certain blending ratio, by fore-spinning process, then spinning the roving yarn to form a spun yarn by spinning process to obtain a yarn with a constant linear density and a blending ratio; or mixing different ingredient rovings by drawing process to get a mixed roving. This invention can produce blended yarn or mixed color yarn at any rate and two or more than two fibers blended by spinning process in a single step.

Definition:

Standard blend ratio is $k_{10}$, $k_{20}$ in the mentioned models as illustrated above, assuming: $\rho_1=\rho_2=\rho$; $V_{h1}+V_{h2}=V_Z$, and are substituted in Equations (6), (7), then:

$$k_{10} = \frac{V_{h1}}{V_{h1} + V_{h2}} = \frac{V_{h1}}{V_z}$$

$$k_{20} = \frac{V_{h2}}{V_{h1} + V_{h2}} = \frac{V_{h2}}{V_z}$$

Thus, the blending ratios of the two ingredients $\rho_1$, $\rho_2$ in the yarn are equal to the inverses of their respective drafting ratios.

$$e_{h1} = \frac{V_Z}{V_{h1}} = \frac{1}{k_1}$$

$$e_{h2} = \frac{V_Z}{V_{h2}} = \frac{1}{k_2}$$

Example:

A scheme of producing blending yarn at any blending ratio with constant linear density and the blending ratio at one-step is showed in Table 4.

TABLE 4

| Scheme of first drafting ratio calculated by blending ratio | | | | | | | | | | | |
|---|---|---|---|---|---|---|---|---|---|---|---|
| $k_1$ | 0 | 0.1 | 0.2 | 0.3 | 0.4 | 0.5 | 0.6 | 0.7 | 0.8 | 0.9 | 1 |
| $e_{h1}$ | | 10 | 5 | 10/3 | 10/4 | 10/5 | 10/6 | 10/7 | 10/8 | 10/9 | 1 |
| $k_2$ | 1 | 0.9 | 0.8 | 0.7 | 0.6 | 0.5 | 0.4 | 0.3 | 0.2 | 0.1 | 0 |
| $e_{h2}$ | 1 | 10/9 | 10/8 | 10/7 | 10/6 | 10/5 | 10/4 | 10/3 | 5 | 10 | |

A scheme of producing color blended yarn at any blending ratio with constant linear density and the blending ratio at one-step is showed in Table 5.

TABLE 5

| Color scheme of different blending ratio | | | | |
|---|---|---|---|---|
| | | Color A Ratio K1 | Color B Ratio K2 | No. |
| Single Color | A | 1 | 0 | 1 |
| | B | 0 | 1 | 2 |
| Blended By Double Colors | AB | 0.1 | 0.9 | 3 |
| | | 0.2 | 0.8 | 4 |
| | | 0.3 | 0.7 | 5 |
| | | 0.4 | 0.6 | 6 |
| | | 0.5 | 0.5 | 7 |
| | | 0.6 | 0.4 | 8 |
| | | 0.7 | 0.3 | 9 |
| | | 0.8 | 0.2 | 10 |
| | | 0.9 | 0.1 | 11 |

DETAILED DESCRIPTION OF THE INVENTION

Figure 1:
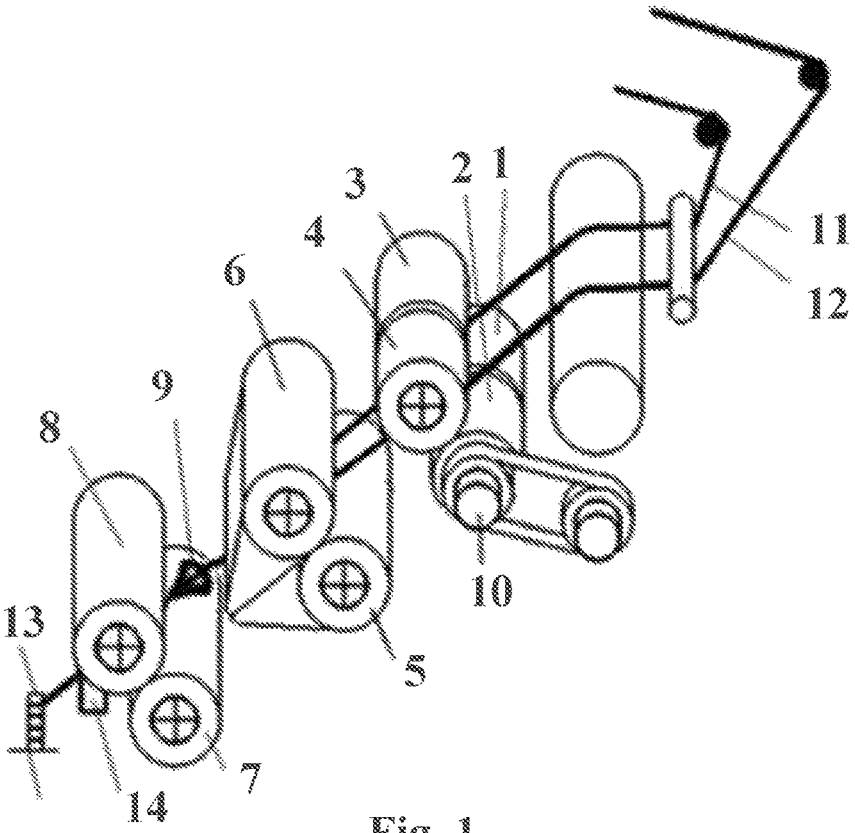
FIG. 1 is a principle schematic diagram of the two-stage drafting spinning device.

The embodiments of the invention are described as below, in combination with the accompanying drawings.

Embodiment 1

A method of configuring linear density and blending ratio of yarn by two-ingredient asynchronous/synchronous drafting is disclosed, comprising:

1) as shown in FIGS. 1-5, a device for implementing the method of dynamically configuring linear density and blending ratio of yarn by two-ingredient asynchronous/synchronous drafting, comprising: a control system, and an actuating mechanism, wherein the actuating mechanism includes a two-ingredient separate/integrated asynchronous/synchronous two-stage drafting mechanism, a twisting mechanism and a winding mechanism; the two-stage drafting mechanism includes a first stage drafting unit and a second stage drafting unit; the first stage drafting unit includes a combination of back rollers and a middle roller; the combination of back rollers includes a first back roller 1, a second back roller 2, which are set abreast on a same back roller shaft. The first back roller 1, the second back roller 2 move at the speeds $V_{h1}$, $V_{h2}$ respectively; the middle roller 5 rotates at the speed $V_z$; 9 is collector.

The second stage drafting unit includes a front roller 7 and a middle roller 5. The front roller rotates at the speed $V_q$.

2) The two roving yarns $\rho_1$, $\rho_2$ are fed into the first stage drafting area, output by the front roller and then twisted with linear density of $\rho_y$ forming yarn Y, then $$\rho_y = \frac{1}{V_q}(V_{h1} * \rho_1 + V_{h2} * \rho_2) \tag{1}$$

the blending ratios first roving yarn ingredient, a second roving yarn ingredient are $k_1$, $k_2$ respectively, then the blending ratio K of yarn Y is:

$$K = \frac{k_1}{k_2} = \frac{\rho_1 V_{h1}}{\rho_2 V_{h2}}$$

4) controlling the linear speed ratio of front roller and middle roller $V_q/V_z$ is constant, thus the speeds of the middle roller and the front roller are adjusted with base linear density of yarn.

5) according to a change of the blending ratio K of the yarn Y with a time t, and a change of the linear density $\rho_y$ of the yarn Y with the time t, a change of surface linear speeds of the first back roller, the second back roller is derived; blending ratios of the first roving yarn ingredient, the second roving yarn ingredient are adjusted.

Then a surface linear speed of the back roller $V_{h1}$ is:

$$V_{h1} = \frac{\rho_y K}{\rho_1 V_q (1+K)}$$

Then a surface linear speed of the back roller $V_{h2}$ is:

$$V_{h2} = \frac{\rho_y}{\rho_2 V_q (1+K)}$$

the colors of a first roving yarn ingredient, a second roving yarn ingredient, drafted by the first back roller, the second back roller are respectively two of yellow, magenta, cyan, and black respectively.

6) Further, let $\rho_1=\rho_2=\rho$, and $V_{h1}+V_{h2}=V_z$, linear density of yarn Y is constant, then the blending ratios of the first roving yarn ingredient, the second roving yarn ingredient are set respectively as $k_1$, $k_2$:

$$k_1 = \frac{V_{h1}}{V_{h1}+V_{h2}} = \frac{V_{h1}}{V_z}$$

$$k_2 = \frac{V_{h2}}{V_{h1}+V_{h2}} = \frac{V_{h2}}{V_z}$$

7) Further, let $\rho_1=\rho_2=\rho$, by adjusting the linear speed of the first back roller, the second back roller, it can be got that: $V_{h1} \rightarrow V_{h1}+\Delta V_{h1}$, $V_{h2} \rightarrow V_{h2}+\Delta V_{h2}$ wherein $\Delta V_{h1}$ is the speed change of the first back roller, and $\Delta V_{h2}$ is the speed change of the second back roller.

Then the linear density of yarn Y is:

$$\rho_y = \frac{\rho}{V_q}[(V_{h1}+V_{h2})+(\Delta V_{h1}+\Delta V_{h2})],$$

And the blending ratios of the first roving ingredient, the second roving yarn $k_1$, $k_2$ respectively are:

$$k_1 = \frac{V_{h1}+\Delta V_{h1}}{V_{h1}+V_{h2}+\Delta V_{h1}+\Delta V_{h2}}$$

$$k_2 = \frac{V_{h2}+\Delta V_{h2}}{V_{h1}+V_{h2}+\Delta V_{h1}+\Delta V_{h2}}$$

Wherein $k_1+k_2=1$;

Therefore linear density $\rho'_y$ of the yarn Y and blending ratios $k_1$, $k_2$ can be changed by changing $\Delta V_{h1}$ and $\Delta V_{h2}$ respectively.

Wherein increases of linear velocity of the first roller and the second roller $\Delta V_{h1}$, $\Delta V_{h2}$ are determined by the set linear density and the blend ratio so that the linear density and the blending ratio of the spun yarn satisfy the predetermined requirements 8) Further, Specific adjustment methods are as follows:

(1) change the speed of the first back roller $V_{h1}$, and keep the speeds of the second backer rollers unchanged. The yarn ingredient and the linear density thereof of the yarn Y drafted by this back roller change accordingly. The linear density $\rho_y'$ of the yarn Y and blending ratio are adjusted as:

$$\rho'_y = \rho_y + \Delta\rho_y = \frac{1}{e_q} * \frac{\rho}{V_z} * [V_{h2} + (V_{h1} + \Delta V_{h1})]$$

$$k_1 = \frac{V_{h1}+\Delta V_{h1}}{V_{h1}+V_{h2}+\Delta V_{h1}}$$

$$k_2 = \frac{V_{h2}}{V_{h1}+V_{h2}+\Delta V_{h1}}$$

wherein $e_q$ is the two-stage drafting ratio, $V_z$ is the linear speed of middle roller, $\rho$ is the linear density of roving, $\Delta\rho_y$ is a linear density change of the yarn.

(2) change the speeds of the second back roller $V_{h2}$ and keep the speeds of the first backer rollers $V_{h1}$ unchanged. The yarn ingredient and linear densities thereof change accordingly. The linear density $\rho_y'$ of yarn Y and blending ratio are adjusted as:

$$\rho'_y = \rho_y + \Delta\rho_y = \frac{1}{e_q} * \frac{\rho}{V_z} * [V_{h1} + V_{h2} + \Delta V_{h2}]$$

$$k_1 = \frac{V_{h1}}{V_{h1}+V_{h2}+\Delta V_{h2}}$$

$$k_2 = \frac{V_{h2}+\Delta V_{h2}}{V_{h1}+V_{h2}+\Delta V_{h2}};$$

(3) change the speeds of the first back roller, the second back roller, simultaneously, and the speeds of the two back rollers are unequal to zero respectively. The yarn ingredients of the yarn Y drafted by these two back rollers and the linear densities thereof change accordingly. The linear density $\rho_y'$ of the yarn Y and blending ratio are adjusted as:

$$\rho'_y = \rho_y + \Delta\rho_y = \frac{\rho}{V_q} * [(V_{h1}+\Delta V_{h1}) + (V_{h2}+\Delta V_{h2})]$$

$$k_1 = \frac{V_{h1}+\Delta V_{h1}}{V_{h1}+V_{h2}+\Delta V_{h1}+\Delta V_{h2}}$$

$$k_2 = \frac{V_{h2}+\Delta V_{h2}}{V_{h1}+V_{h2}+\Delta V_{h1}+\Delta V_{h2}};$$

(4) change the speeds of the first back roller, the second back roller simultaneously, and make the speeds of one back rollers equal to zero, while the speeds of the other one backer rollers unequal to zero. The yarn ingredients of the yarn Y drafted by the one back rollers is thus discontinuous, while the other yarn ingredients is continuous.

(5) Further, change the speeds of the first back roller, the second back roller, successively at successive time point $T_1$, $T_2$, $T_3$, $T_4$, $T_5$, make the speeds of one back rollers equal to zero, while the speeds of the other one backer rollers unequal to zero, then linear density $\rho_y'$ of the yarn Y and blending ratio are adjusted as:

① when $T_1 \leq t \leq T_2$, $$\rho'_y = \rho_y + \Delta\rho_y = \frac{\rho}{V_q} * [(V_{h1}+\Delta V_{h1}) + (V_{h2}+\Delta V_{h2})]$$

$$k_1 = \frac{V_{h1}+\Delta V_{h1}}{V_{h1}+V_{h2}+\Delta V_{h1}+\Delta V_{h2}}$$

$$k_2 = \frac{V_{h2}+\Delta V_{h2}}{V_{h1}+V_{h2}+\Delta V_{h1}+\Delta V_{h2}}$$

② when $T_2 \le t \le T_3$ $$\rho'_y = \rho_y + \Delta\rho_y = \frac{\rho}{V_q} * (V_{h2} + \Delta V_{h2})$$

$$k_1 = 0$$

$$k_2 = 1$$

③ when $T_3 \le t \le T_4$ $$\rho'_y = \rho_y + \Delta\rho_y = \frac{\rho}{V_q} * [(V_{h1} + \Delta V_{h1}) + (V_{h2} + \Delta V_{h2})]$$

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}}$$

④ when $T_4 \le t \le T_5$ $$\rho'_y = \rho_y + \Delta\rho_y = \frac{\rho}{V_q} * (V_{h2} + \Delta V_{h2})$$

$$k_1 = 1$$

$$k_2 = 0$$

Embodiment 2

The method of this embodiment is substantially the same as Embodiment 1, and the differences are:

(1) Further, according to the set blending ratio and/or linear density, divide the yarn Y into n segments. The linear density and blending ratio of each segment of the yarn Y are the same, while the linear densities and blending ratios of the adjacent segments are different. When drafting the segment i of the yarn Y, the linear speeds of the first back roller, the second back roller are $V_{h1i}$, $V_{h2i}$, wherein $i \in (1, 2, \ldots, n)$ The first roving ingredient, the second roving ingredient are two-stage drafted and twisted to form segment i of the yarn Y, and the blending ratios $k_{1i}$, $k_{2i}$ thereof are expressed as below:

$$k_{1i} = \frac{\rho_1 * V_{h1i}}{\rho_1 * V_{h1i} + \rho_2 * V_{h2i}} \quad (2)$$

$$k_{2i} = \frac{\rho_2 * V_{h2i}}{\rho_1 * V_{h1i} + \rho_2 * V_{h2i}} \quad (3)$$

the linear density of segment i of yarn Y is:

$$\rho_{yi} = \frac{V_Z}{V_q} * \left(\frac{V_{h1i}}{V_Z} * \rho_1 + \frac{V_{h2i}}{V_Z}\rho_2\right) = \frac{1}{e_q} * \left(\frac{V_{h1i}}{V_Z} * \rho_1 + \frac{V_{h2i}}{V_Z}\rho_2\right) \quad (4)$$

wherein $$e_q = \frac{V_q}{V_z}$$

is the two-stage drafting ratio;

Take the segment with the lowest density as a reference segment, whose reference linear density is $\rho_0$. The reference linear speeds of the first back roller, the second back roller, for this segment are respectively $V_{h10}$, $V_{h20}$; and the reference blending ratios of the first roving yarn ingredient, the second roving yarn ingredient, for this segment are respectively $k_{10}$, $k_{20}$, Keep the linear speed of the middle roller constant, and $$V_z = V_{h10} + V_{h20} \quad (5);$$

also keep two-stage drafting ratio $$e_q = \frac{V_q}{V_z}$$

constant;

wherein the reference linear speeds of the first back roller, the second back roller for this segment are respectively $V_{h10}$, $V_{h20}$, which can be predetermined according to the material, reference linear density $\rho_0$ and reference blending ratios $k_{10}$, $k_{20}$ of the first roving ingredient, the second roving ingredient.

When the segment i of the yarn Y is drafted and blended, on the premise of known set linear density $\rho_{yi}$ and blending ratios $k_{1i}$, $k_{2i}$, the linear speeds $V_{h1i}$, $V_{h2i}$, of the first back roller, the second back roller are calculated according to Equations (2)-(5);

Based on the reference linear speeds $V_{h10}$, $V_{h20}$ for the reference segment, increase or decrease the rotation rates of the first back roller, or/and the second back roller to dynamically adjust the linear density or/and blending ratio for the segment i of the yarn Y.

(2) Further, let $\rho_1 = \rho_2 = \rho$, the Equation (4) can be simplified as $$\rho_{yi} = \frac{\rho}{e_q} * \frac{V_{h1i} + V_{h2i}}{V_Z}. \quad (6)$$

According to Equations (2), (3), (5) and (6), the linear speeds $V_{h1i}$, $V_{h2i}$ of the first back roller, the second back roller are calculated; based on the reference linear speeds $V_{h10}$, $V_{h20}$, the rotation rates of the first back roller, or/and the second back roller are increased or decreased to reach the preset linear density and blending ratio for the segment i of yarn Y.

(3) Further, at the moment of switching the segment i−1 to the segment i of yarn Y, let the linear density of the yarn Y increase by dynamic increment $\Delta\rho_{yi}$, i.e., thickness change $\Delta\rho_{yi}$, on the basis of reference linear density; and thus the first back roller, the second back roller have corresponding increments on the basis of the reference linear speed, i.e., when $(V_{h10}+V_{h20}) \rightarrow (V_{h10}\Delta V_{h1i}+V_{h20}+\Delta V_{h2i})$, the linear density increment of yarn Y is:

$$\Delta\rho_{yi} = \frac{\rho}{e_q * V_Z} * (\Delta V_{h1i} + \Delta V_{h2i});$$

Then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i}}{V_Z} * \frac{\rho}{e_q}. \quad (7)$$

Let $\Delta V_1=\Delta V_{h1i}+\Delta V_{h2i}$, then Equation (7) is simplified as:

$$\rho_{yi}=\rho_{y0}+\frac{\Delta V_i}{V_Z}*\frac{\rho}{e_q}. \tag{8}$$

The linear density of yarn Y can be adjusted by controlling the sum of the linear speed increments $\Delta V_i$ of the first back roller, the second back roller.

(4) Further, let $\rho_1=\rho_2=\rho$, at the moment of switching the segment i−1 to the segment i of the yarn Y, the blending ratios of the yarn Y in Equations (2) and (3) can be simplified as:

$$k_{1i}=\frac{V_{h10}+\Delta V_{h1i}}{V_Z+\Delta V_i} \tag{9}$$

$$k_{2i}=\frac{V_{h20}+\Delta V_{h2i}}{V_Z+\Delta V_i} \tag{10}$$

The blending ratios of the yarn Y can be adjusted by controlling the linear speed increments of the first back roller, the second back roller;

wherein $$\Delta V_{h1i}=k_{1i}*(V_Z+\Delta V_i)-V_{h10}$$

$$\Delta V_{h2i}=k_{2i}*(V_Z+\Delta V_i)-V_{h20}.$$

(5) Further, let $V_{h1i}*\rho_1+V_{h2i}*\rho_2=H$ and H is a constant, then $\Delta V_i$ is constantly equal to zero, and thus the linear density is unchanged when the blending ratios of the yarn Y are adjusted.

(6) Further, let any one of $\Delta V_{h1i}$, $\Delta V_{h2i}$ be equal to zero, while the remaining one is not zero, then the one roving yarn ingredients can be changed while the other roving yarn ingredients is unchanged. The adjusted blending ratio are:

$$k_{1i}=\frac{V_{h10}+\Delta V_{h1i}}{V_Z+\Delta V_{h1i}}$$

$$k_{2i}=\frac{V_{h20}}{V_Z+\Delta V_{h1i}}$$

or $$k_{1i}=\frac{V_{h10}}{V_Z+\Delta V_{h2i}}$$

$$k_{2i}=\frac{V_{h20}+\Delta V_{h2i}}{V_Z+\Delta V_{h2i}}.$$

Further, let none of $\Delta V_{h1i}$ and $\Delta V_{h2i}$ be equal to zero, then the proportion of the two roving yarn ingredients in the yarn Y may be changed. The adjusted blending ratio are:

$$k_{1i}=\frac{V_{h10}+\Delta V_{h1i}}{V_Z+\Delta V_i}$$

$$k_{2i}=\frac{V_{h20}+\Delta V_{h2i}}{V_Z+\Delta V_i}.$$

(7) Further, let one of $\Delta V_{h1i}$, $\Delta V_{h2i}$ be equal to zero, while the remaining one is not zero, then the one roving yarn ingredients of the segment i of the yarn Y may be discontinuous, thus yarn Y only has one roving ingredient.

Embodiment 3

The method of this embodiment is substantially the same as Embodiment 1, and the differences are:

(1) Further, according to the set blending ratio and/or linear density, divide the yarn Y into n segments. The linear density and blending ratio of each segment of the yarn Y are the same, while the linear densities and blending ratios of the adjacent segments are different. When drafting the segment i of the yarn Y, the linear speeds of the first back roller, the second back roller are $V_{h1i}$, $V_{h2i}$, the linear speeds of middle roller is $V_{zi}$, the linear speeds of front roller is $V_{qi}$, wherein $i\in(1, 2, \ldots, n)$ The first roving ingredient, the second roving ingredient are two-stage drafted and twisted to form segment i of the yarn Y, and the blending ratios $k_{1i}$, $k_{2i}$ thereof are expressed as below:

$$k_{1i}=\frac{\rho_1*V_{h1i}}{\rho_1*V_{h1i}+\rho_2*V_{h2i}} \tag{32}$$

$$k_{2i}=\frac{\rho_2*V_{h2i}}{\rho_1*V_{h1i}+\rho_2*V_{h2i}} \tag{33}$$

the linear density of segment i of yarn Y is:

$$\rho_{yi}=\frac{V_{Zi}}{V_{qi}}*\left(\frac{V_{h1i}}{V_{Zi}}*\rho_1+\frac{V_{h2i}}{V_{Zi}}\rho_2\right)=\frac{1}{e_{qi}}*\left(\frac{V_{h1i}}{V_{Zi}}*\rho_1+\frac{V_{h2i}}{V_{Zi}}\rho_2\right) \tag{34}$$

wherein $$e_q=\frac{V_q}{V_z}$$

is the two-stage drafting ratio;

Assuming reference linear speeds of the first back roller, the second back roller, for this segment are respectively $V_{h10}$, $V_{h20}$; the linear speed of the middle roller is $V_{s0}=V_{h10}+V_{h20}$;

Additionally, assuming $$V_{zi}=V_{h1(i-1)}+V_{h2(i-1)} \tag{35}$$

also keep two-stage drafting ratio $$e_{qi}=\frac{V_{qi}}{V_{zi}}$$

as constant $e_q$;

When the segment i of the yarn Y is drafted and blended, taking the linear density and the blending ratio of the yarn Y in the i−1 stage as the reference linear density and the reference blend ratio, on the premise of known set linear density $\beta_{yi}$ and blending ratios $k_{1i}$, $k_{2i}$ of segment i, the linear speeds $V_{h1i}$, $V_{h2i}$, of the first back roller, the second back roller are calculated according to Equations (32)-(35);

Adjusting the rotational speed of the first back roller and/or the second back roller on the basis of the i−1 stage to realize the on-line dynamic adjustment of the linear density or/and the blending ratio of the yarn Y of the i stage.

This method makes the middle roller and the front roller constantly adjust with the speed of the rear combination roller by making $V_{zi}=V_{h1(i-1)}+V_{h2(i-1)}$ and the second draft ratio constant, avoiding back roller adjustment is too large, and the middle roller and the front roller speed is not adjusted in time leading to a significant change in yarn traction, and the effective control of the occurrence of yarn broken.

In addition, by computers or other intelligent control unit at any time record the running speed of the roller, the known existing roller speed, it can automatically calculate the next step of the middle roller and the front roller speed, the use of the formula and model to quickly calculate the combination of increase and decrease of roller speed, thus achieving the blending ratio and linear density adjustment, which is more simple and accurate.

(2) Let $\rho_1=\rho_2=\rho$, the Equation (34) can be simplified as $$\rho_{yi} = \frac{\rho}{e_q} * \frac{V_{h1i} + V_{h2i}}{V_{Zi}}. \tag{36}$$

According to Equations (32), (33), (35) and (36), the linear speeds $V_{h1i}$, $V_{h2i}$ of the first back roller, the second back roller are calculated; based on the reference linear density $\rho_{y(i-1)}$ and reference blending ratio $k_{1(i-1)}$ and $k_{2(i-1)}$, the rotation rates of the first back roller, or/and the second back roller are increased or decreased to reach the preset linear density and blending ratio for the segment i of yarn Y.

(3) Assuming linear density dynamic change $\Delta\rho_{yi}$, on the basis of reference linear density, resulting the linear density changing of yarn Y;

when the first back roller, the second back roller have corresponding increments i.e., $(V_{h1}+V_{h2})\rightarrow(V_{h1}+\Delta V_{h1}+V_{h2}+\Delta V_{h2})$ the linear density increment of yarn Y is:

$$\Delta\rho_{yi} = \frac{\rho}{e_q * V_Z} * (\Delta V_{h1} + \Delta V_{h2})$$

then at the moment of switching the segment i−1 to the segment i of the yarn Y, the linear density $\rho_{yi}$ of the yarn Y is expressed as $$\rho_{yi} = \rho_{y(i-1)} + \Delta\rho_{yi} = \rho_{y(i-1)} + \frac{\Delta V_{h1i} + \Delta V_{h2i}}{V_{Zi}} * \frac{\rho}{e_q} \tag{37}$$

Let $\Delta V_1=\Delta V_{h1i}+\Delta V_{h2i}$, then Equation (37) is simplified as:

$$\rho_{yi} = \rho_{y(i-1)} + \frac{\Delta V_i}{V_{Zi}} * \frac{\rho}{e_q}. \tag{38}$$

The linear density of yarn Y can be adjusted by controlling the sum of the linear speed increments $\Delta V_i$ of the first back roller, the second back roller.

(4) Let $\rho_1=\rho_2=\rho$, at the moment of switching the segment i−1 to the segment i of the yarn Y, the blending ratios of the yarn Yin Equations (32) and (33) can be simplified as:

$$k_{1i} = \frac{V_{h1(i-1)} + \Delta V_{h1i}}{V_{Zi} + \Delta V_i} \tag{39}$$

-continued $$k_{2i} = \frac{V_{h2(i-1)} + \Delta V_{h2i}}{V_{Zi} + \Delta V_i} \tag{40}$$

The blending ratios of the yarn Y can be adjusted by controlling the linear speed increments of the first back roller, the second back roller;

wherein $$\Delta V_{h1i}=k_{1i}*(V_{Zi}+\Delta V_i)-V_{h1(i-)}$$

$$\Delta V_{h2i}=k_{2i}*(V_{Zi}+\Delta V_i)-V_{h2(i-1)}.$$

(5) Let $V_{h1i}*\rho_i+V_{h2i}*\rho_2=H$ and H is a constant, then $\Delta V_i$ is constantly equal to zero, and thus the linear density is unchanged when the blending ratios of the yarn Y are adjusted by the increasing or decreasing the speed of the first back roller, while reducing or increasing the speed of the second back roller.

(6) Further, let any one of $\Delta V_{h1i}$, $\Delta V_{h2i}$ be equal to zero, while the remaining one is not zero, then the one roving yarn ingredients can be changed while the other roving yarn ingredients is unchanged. The adjusted blending ratio are:

$$k_{1i} = \frac{V_{h1(i-1)} + \Delta V_{h1i}}{V_{Zi} + \Delta V_{h1i}}$$

$$k_{2i} = \frac{V_{h2(i-1)}}{V_{Zi} + \Delta V_{h1i}}$$

or $$k_{1i} = \frac{V_{h1(i-1)}}{V_{Zi} + \Delta V_{h2i}}$$

$$k_{2i} = \frac{V_{h2(i-1)} + \Delta V_{h2i}}{V_{Zi} + \Delta V_{h2i}}$$

Let none of $\Delta V_{h1i}$ and $\Delta V_{h2i}$ be equal to zero, then the proportion of the two roving yarn ingredients in the yarn Y may be changed, the adjusted blending ratio are:

$$k_{1i} = \frac{V_{h1(i-1)} + \Delta V_{h1i}}{V_{Zi} + \Delta V_i}$$

$$k_{2i} = \frac{V_{h2(i-1)} + \Delta V_{h2i}}{V_{Zi} + \Delta V_i}.$$

Let one of $\Delta V_{h1i}$, $\Delta V_{h2i}$ be equal to zero, while the remaining one is not zero, then the one roving yarn ingredients of the segment i of the yarn Y may be discontinuous, thus yarn Y only has one roving ingredient.

Embodiment 4

As demonstrated by FIG. 1-5, a device for configuring linear density and blending ratio of yarn by two-ingredient asynchronous/synchronous drafted, comprises a control system and an actuating mechanism. The actuating mechanism includes two-ingredient asynchronous/synchronous two-stage drafting mechanism, a twisting mechanism and a winding mechanism. The two-stage drafting mechanism includes a first stage drafting unit and a second stage drafting unit; the first stage drafting unit includes a combination of back rollers 10 and a middle roller 5. The combination of back rollers includes a first back roller 2 and a second back roller 1 which are set abreast on a same back roller shaft. The second stage drafting unit includes a front roller 7 and the middle roller 5. 3 and 4 are top rollers of back rollers respectively, 6 is the top rollers of middle roller, 8 is the top roller of front roller. 9 is the collector. 13 and 14 are winding device and yarn guider roller. $O_1$, $O_2$, $O_3$, respectively refer to axis lines of back rollers, the middle roller and the front roller.

Figure 2:
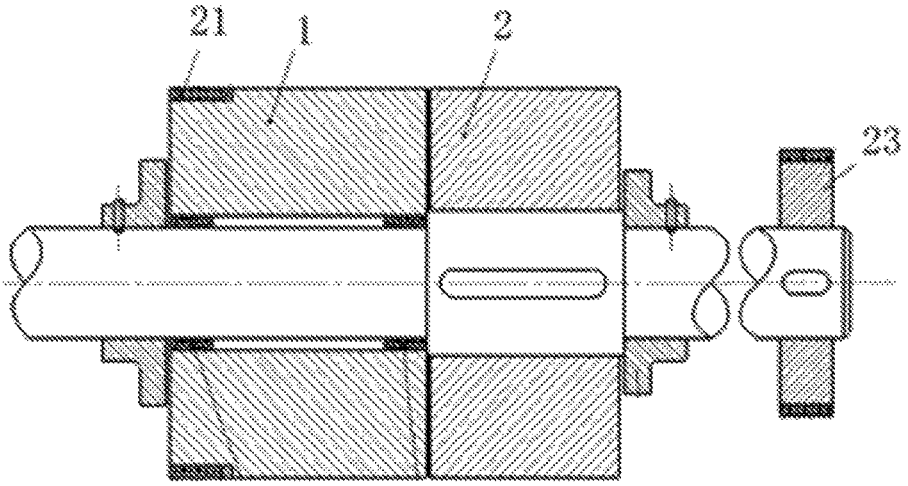
FIG. 2 is a structural schematic diagram of a combination of back rollers.
Figure 3:
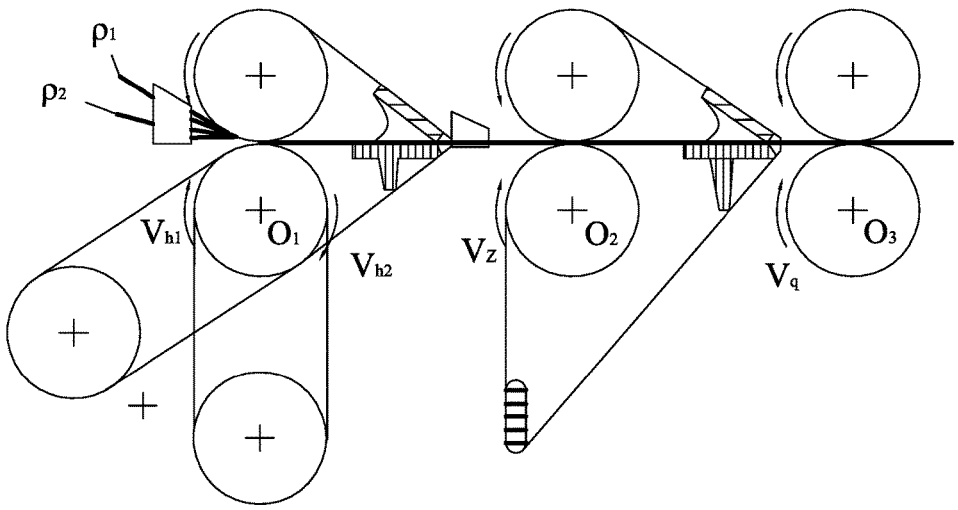
FIG. 3 is a structural side view of the two-stage drafting spinning device.
Figure 4:
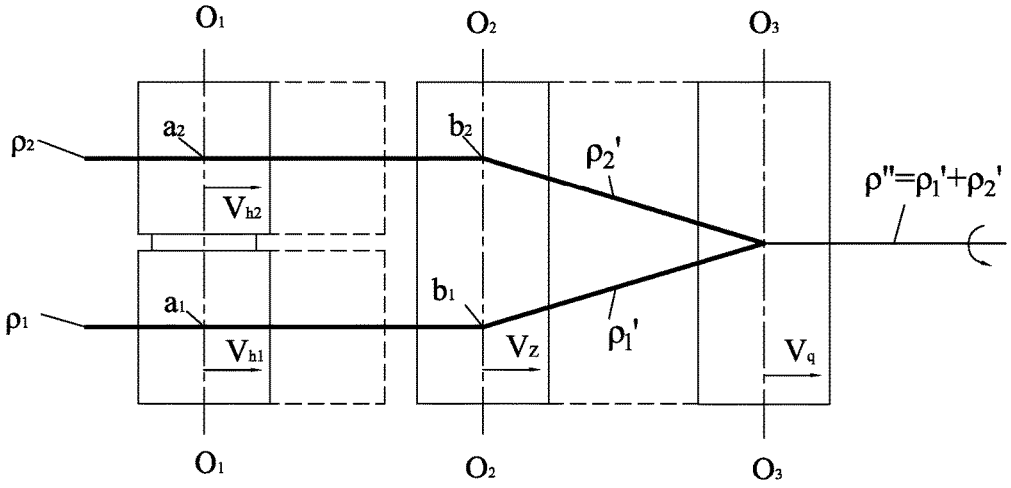
FIG. 4 is a yarn route of the two-stage drafting in an embodiment.

As shown in FIG. 2, the first back rollers 2 are fixed on core shaft of back roller and driven by pulleys 23. The first back rollers are placed rotatably on the core shaft of back roller, and driven by toroidal ring 21.

During spinning process, two roving yarns 11 and 12 are located by a guide rod and a bell mouth in the process of drafting and twisting. Two rovings are fed into the first stage drafting area by the back rollers at different speeds $V_{h1}$, $V_{h2}$ respectively, as showed in FIG. 4, and travel in parallel to the holding points of middle roller and output at the speed $V_z$.

The asynchronously drafted ratios of the two rovings are $e_{h1}=(V_Z-V_{h2})/V_{h1}$ and $e_{h2}=(V_Z-V_{h1})/V_{h2}$ respectively. And then the drafted slivers were fed into second drafting zone with linear density of $\rho_1'$ and $\rho_2'$ respectively. After second time drafted by the front roller at the surface speed $V_q$, two slivers were twisting together forming a yarn with linear density of $\rho_1''$ and $\rho_2''$ respectively.

The first drafting zone can dynamically controlling the blend ratio (or color ratio) and yarn linear density, and the second drafting zone can determine the referenced linear density of yarn with changeable linear density.

Figure 5:
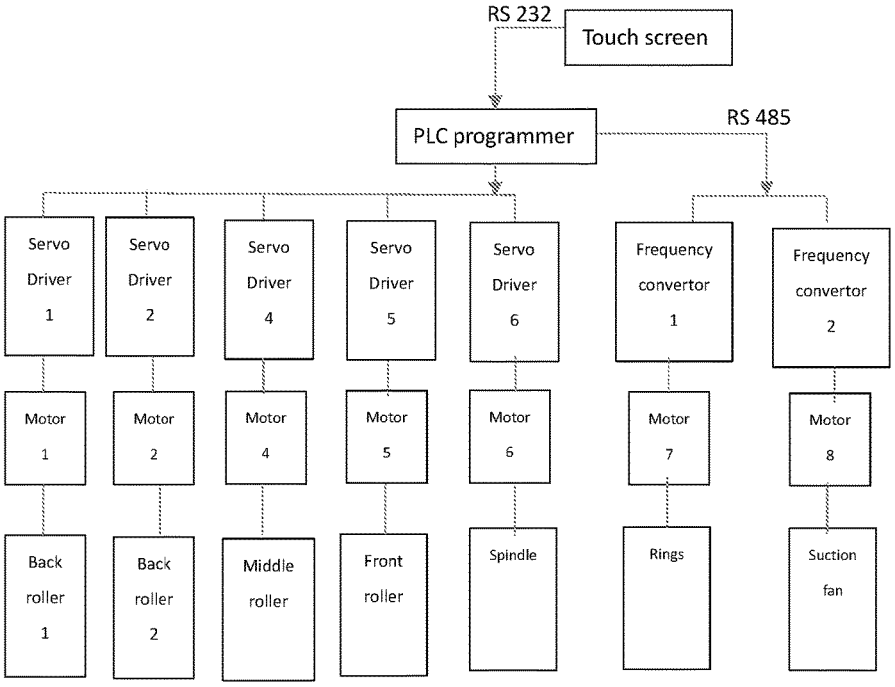
FIG. 5 is a structural schematic diagram of a control system.

Further, as showed in FIG. 5, the control system mainly includes a PLC programmable controller, a servo driver, a servo motor, Recommended Standard (RS) 232 and RS 485, etc. PLC programmable controller controls rollers, ring plate and spindle by motor controlled by servo drive.

TABLE 6

Parameter comparison between asynchronous drafting and synchronous drafting (taking 18.45 tex cotton yarn as an example)

| | Synchronous drafting for single ingredient spinning | | Synchronous drafting for double ingredients spinning | | Synchronous drafting for double ingredients spinning | | Asynchronous drafting for two ingredients spinning | | | |
|---|---|---|---|---|---|---|---|---|---|---|
| | | | Ingredient 1 | Ingredient 2 | Ingredient 1 | Ingredient 2 | Ingredient 1 | Ingredient 2 | | |
| Roving yarn weight (g/5 m) | 5.0 | | 5.0 | 5.0 | 5.0 | 5.0 | 5.0 | 5.0 | | |
| Back area drafting ratio | 1.1-1.3 | 1.1-1.3 | 1.1-1.3 | 1.1-1.3 | 1.1-1.3 | 1.1-1.3 | 2 * (k1 + k2)/k1 Changes with the blending ratio | 2 * (k1 + k2/k2 Changes with the blending ratio | | |
| Front area drafting ratio | 24.6-20.8 | 22.7 | 49.2-41.6 | 49.2~41.6 | 45.4 | 45.4 | 54.2 | 54.2 | | |
| Back rollers speed | unchanged | changed | unchanged | | changed | | Asynchronous change | Asynchronous change | | |
| Middle roller speed | unchanged | unchanged | unchanged | | unchanged | | unchanged | | | |
| Front roller speed | unchanged | unchanged | unchanged | | unchanged | | unchanged | | | |
| Average spinning number (tex) | 18.45 | 18.45 | 18.45 | | 18.45 | | 18.45 | | | |
| Linear speed variable | invariable | Limitedly variable | invariable | | Limitedly variable | | Variable, adjustable | | | |
| Blending ratio variable | invariable | invariable | invariable | | Limitedly variable | | Variable, adjustable | | | |
| Linear speed and blending ratio both variable | invariable | invariable | invariable | | Limitedly variable | | Variable, adjustable | | | |
| Spinning effect | Even yarn | Slub yarn | Even yarn | | Limited segmented color Limited slub yarn | | Even yarn Any blending ratio Color-blended yarn | Even yarn Any blending ratio Segment-color blended yarn | Even yarn Any blending ratio Segment-color slub yarn | Even yarn Any blending ratio slub yarn |

Several preferable embodiments are described, in combination with the accompanying drawings. However, the invention is not intended to be limited herein. Any improvements and/or modifications by the skilled in the art, without departing from the spirit of the invention, would fall within protection scope of the invention.

The invention claimed is:

1. A method of dynamically configuring a linear density and a blending ratio of a yarn by two-ingredient asynchronous/synchronous drafting, the method comprising:

1) providing an actuating mechanism, wherein the actuating mechanism includes a two-ingredient asynchronous/synchronous two-stage drafting mechanism, a twisting mechanism and a winding mechanism; wherein the two-ingredient asynchronous/synchronous two-stage drafting mechanism includes a first stage asynchronous drafting unit and a successive second stage synchronous drafting unit;

2) providing a combination of a plurality of back roller and a middle roller included by the first stage asynchronous drafting unit; the combination of the back rollers has two rotational degrees of freedom and includes a first back roller, a second back roller, which are set abreast on a same back roller shaft; the first back roller, the second back roller move at the speeds $V_{h1}$, $V_{h2}$ respectively; the middle roller rotates at the speed $V_z$; the second stage synchronous drafting unit includes a front roller and the middle roller; the front roller rotates at the surface linear speed $V_q$;

assuming the linear densities of a first roving yarn ingredient, a second roving yarn ingredient, drafted by the first back roller, the second back roller are respectively $\rho_1$, $\rho_2$, the linear density of the yarn Y drafted and twisted by the front roller is $\rho_y$;

$$\rho_y = \frac{1}{V_q}(V_{h1} * \rho_1 + V_{h2} * \rho_2) \tag{1}$$

blending ratios of the first roving yarn ingredient, the second roving yarn ingredient are respectively $k_1$, $k_2$;

$$K = \frac{k_1}{k_2} = \frac{\rho_1 V_{h1}}{\rho_2 V_{h2}}$$

3) keeping the ratio of linear speeds of the front roller and the middle roller $V_q/V_z$ constant, the speeds of the front roller and the middle roller depend on reference linear density of the yarn;

4) adjusting the rotation rates of the first back roller, the second back roller, so as to adjust the linear density of yarn Y or/and blending ratio, according to the changes of the blending ratio K of the yarn Y with a time t, and the changes of the linear density $\rho_y$ of the yarn Y with the time t, the changes of the surface linear speeds of the first back roller, the second back roller, are derived;

wherein surface linear speeds of the first back roller $V_{h1}$:

$$V_{h1} = \frac{\rho_y K}{\rho_1 V_q (1 + K)}$$

surface linear speeds of the second back roller $V_{h2}$:

$$V_{h2} = \frac{\rho_y}{\rho_2 V_q (1 + K)}.$$

2. The method of claim 1, wherein let $\rho_1=\rho_2=\rho$, and $V_{h1}+V_{h2}=V_z$, the linear density of yarn Y is constant, then the blending ratios of the first roving yarn ingredient, the second roving yarn ingredient are set respectively as $k_1$, $k_2$:

$$k_1 = \frac{V_{h1}}{V_{h1} + V_{h2}} = \frac{V_{h1}}{V_z}$$

$$k_2 = \frac{V_{h2}}{V_{h1} + V_{h2}} = \frac{V_{h2}}{V_z}.$$

3. The method of claim 1, wherein let $\rho_1=\rho_2=\rho$, by adjusting the linear speeds of the first back roller, the second back roller, it is got that: $V_{h1} \rightarrow V_{h1}+\Delta V_{h1}$, $V_{h2} \rightarrow V_{h2}+\Delta V_{h2}$, wherein $\Delta V_{h1}$ is the speed change of the first back roller, and $\Delta V_{h2}$ is the speed change of the second back roller;

then the linear density of yarn Y is:

$$\rho_y = \frac{\rho}{V_q}[(V_{h1} + V_{h2}) + (\Delta V_{h1} + \Delta V_{h2})],$$

and the blending ratios of the first roving yarn ingredient, the second roving yarn ingredient $k_1$, $k_2$ respectively are:

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}}$$

wherein $k_1+k_2=1$;

therefore the linear density $\rho_y'$ of the yarn Y and blending ratios $k_1$, $k_2$ are changed by changing $\Delta V_{h1}$ and $\Delta V_{h2}$ respectively;

wherein increases of linear velocity of the first back roller and the second back roller $\Delta V_{h1}$, $\Delta V_{h2}$ are determined by the set linear density and the blend ratio so that the linear density and the blending ratio of the spun yarn satisfy predetermined requirements.

4. The method of claim 3, wherein specific adjustment methods are as follows:

1) changing the speed of the first back roller $V_{h1}$, and keeping the speeds of the second back rollers $\Delta V_{h2}$ unchanged; yarn ingredients and the linear density of the yarn Y drafted by this back roller change accordingly; the linear density $\rho_y'$ of the yarn Y and blending ratio are adjusted as:

$$\rho_y' = \rho_y + \Delta\rho_y = \frac{1}{e_q} * \frac{\rho}{V_z} * [V_{h2} + (V_{h1} + \Delta V_{h1})]$$

$$k_1 = \frac{V_{h1} + \Delta V_{h1}}{V_{h1} + V_{h2} + \Delta V_{h1}}$$

$$k_2 = \frac{V_{h2}}{V_{h1} + V_{h2} + \Delta V_{h1}}$$

wherein $e_q$ is the two-stage drafting ratio, $V_z$ is the linear speed of middle roller, ρ is the linear density of roving, $\Delta\rho_y$ is a linear density change of the yarn;

2) changing the speeds of the second back roller $V_{h2}$ and keeping the speeds of the first back rollers $V_{h1}$ unchanged; the yarn ingredients and linear densities thereof change accordingly; the linear density $\rho_y'$ of yarn Y and blending ratio are adjusted as:

$$\rho_y' = \rho_y + \Delta\rho_y = \frac{1}{e_q} * \frac{\rho}{V_z} * [V_{h1} + V_{h2} + \Delta V_{h2}]$$

$$k_1 = \frac{V_{h1}}{V_{h1} + V_{h2} + \Delta V_{h2}}$$

$$k_2 = \frac{V_{h2} + \Delta V_{h2}}{V_{h1} + V_{h2} + \Delta V_{h2}};$$

3) changing the speeds of the first back roller, the second back roller, simultaneously, and the speeds of the two back rollers are unequal to zero respectively; the yarn ingredients of the yarn Y drafted by these two back rollers and the linear densities thereof change accordingly; the linear density $\rho_y'$ of the yarn Y and blending ratio are adjusted as:

$$\rho_y' = \rho_y + \Delta\rho_y = \frac{\rho}{V_q} * [(V_{h1} + \Delta V_{h1}) + (V_{h2} + \Delta V_{h2})]$$

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}};$$

4) changing the speeds of the first back roller, the second back roller simultaneously, and making the speeds of one back rollers equal to zero, while the speeds of the other one back rollers unequal to zero; the yarn ingredients of the yarn Y drafted by the one back rollers is thus discontinuous, while the other yarn ingredients is continuous.

5. The method of claim 4, wherein changing the speeds of the first back roller, the second back roller, successively at successive time point $T_1$, $T_2$, $T_3$, $T_4$, $T_5$, making the speeds of one back rollers equal to zero, while the speeds of the other one back rollers unequal to zero, then the linear density $\rho_y'$ of the yarn Y and blending ratio are adjusted as:

(1) when $T_1 \le t \le T_2$, $$\rho_y' = \rho_y + \Delta\rho_y = \frac{\rho}{V_q} * [(V_{h1} + \Delta V_{h1}) + (V_{h2} + \Delta V_{h2})]$$

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}}$$

(2) when $T_2 \le t \le T_3$ $$\rho_y' = \rho_y + \Delta\rho_y = \frac{\rho}{V_q} * (V_{h2} + \Delta V_{h2})$$

-continued $$k_1 = 0$$

$$k_2 = 1$$

(3) when $T_3 \le t \le T_4$ $$\rho_y' = \rho_y + \Delta\rho_y = \frac{\rho}{V_q} * [(V_{h1} + \Delta V_{h1}) + (V_{h2} + \Delta V_{h2})]$$

$$k_1 = \frac{V_{h1} + \Delta V_{h1}}{V_{h1} + V_{h2} + \Delta V_{h1} + \Delta V_{h2}}$$

$$k_2 = \frac{V_{h2} + \Delta V_{h2}}{V_{h1} + V_{h2} + \Delta V_{h1} + \Delta V_{h2}}$$

(4) when $T_4 \le t \le T_5$ $$\rho_y' = \rho_y + \Delta\rho_y = \frac{\rho}{V_q} * (V_{h2} + \Delta V_{h2})$$

$$k_1 = 1$$

$$k_2 = 0.$$

6. The method of claim 1, wherein according to the set blending ratio and/or linear density, divides the yarn Y into n segments; the linear density and blending ratio of each segment of the yarn Y are the same, while the linear densities and blending ratios of the adjacent segments are different; when drafting the segment i of the yarn Y, the linear speeds of the first back roller and the second back roller, are $V_{h1i}$, $V_{h2i}$, wherein $i \in (1, 2, \ldots, n)$;

the first roving yarn ingredient, the second roving yarn ingredient, are two-stage drafted and twisted to form segment i of the yarn Y, and the blending ratios $k_{1i}$, $k_{2i}$ thereof are expressed as below:

$$k_{1i} = \frac{\rho_1 * V_{h1i}}{\rho_1 * V_{h1i} + \rho_2 * V_{h2i}} \quad (2)$$

$$k_{2i} = \frac{\rho_2 * V_{h2i}}{\rho_1 * V_{h1i} + \rho_2 * V_{h2i}} \quad (3)$$

the linear density of segment i of yarn Y is:

$$\rho_{yi} = \frac{V_Z}{V_q} * \left(\frac{V_{h1i}}{V_Z} * \rho_1 + \frac{V_{h2i}}{V_Z}\rho_2\right) = \frac{1}{e_q} * \left(\frac{V_{h1i}}{V_Z} * \rho_1 + \frac{V_{h2i}}{V_Z}\rho_2\right) \quad (4)$$

wherein $$e_q = \frac{V_q}{V_z}$$

is the two-stage drafting ratio;

taking the segment with the lowest density as a reference segment, whose reference linear density is $\rho_0$; the reference linear speeds of the first back roller, the second back roller, for this segment are respectively $V_{h10}$, $V_{h20}$; and the reference blending ratios of the first roving yarn ingredient, the second roving yarn ingredient, for this segment are respectively $k_{10}$, $k_{20}$, keeping the linear speed of the middle roller constant, and $$V_z = V_{h10} + V_{h20} \quad (5);$$

also keeping two-stage drafting ratio $$e_q = \frac{V_q}{V_z}$$

constant;

wherein the reference linear speeds of the first back roller, the second back roller for this segment are respectively $V_{h10}$, $V_{h20}$, which are predetermined according to the material, reference linear density $\rho_0$ and reference blending ratios $k_{10}$, $k_{20}$ of the first roving yarn ingredient, the second roving yarn ingredient;

when the segment i of the yarn Y is drafted and blended, on the premise of known set the linear density $\rho_{yi}$ and blending ratios $k_{1i}$, $k_{2i}$, the linear speeds $V_{h1i}$, $V_{h2i}$, of the first back roller, the second back roller are calculated according to Equations (2)-(5);

based on the reference linear speeds $V_{h10}$, $V_{h20}$ for the reference segment, increase or decrease the rotation rates of the first back roller, or/and the second back roller to dynamically adjust the linear density or/and blending ratio for the segment i of the yarn Y.

7. The method of claim 6, wherein let $\rho_1=\rho_2=\rho$ the, the Equation (4) is simplified as $$\rho_{yi} = \frac{\rho}{e_q} * \frac{V_{h1i} + V_{h2i}}{V_Z}; \tag{6}$$

according to Equations (2), (3), (5) and (6), the linear speeds $V_{h1i}$, $V_{h2i}$ of the first back roller, the second back roller are calculated; based on the reference linear speeds $V_{h10}$, $V_{h20}$, the rotation rates of the first back roller, or/and the second back roller are increased or decreased to reach the preset linear density and blending ratio for the segment i of yarn Y.

8. The method of claim 7, wherein at the moment of switching the segment i−1 to the segment i of yarn Y, let the linear density of the yarn Y increase by dynamic increment $\Delta\rho_{yi}$, i.e., thickness change $\Delta\rho_{yi}$, on the basis of reference linear density; and thus the first back roller, the second back roller have corresponding increments on the basis of the reference linear speed, i.e., when $(V_{h10}+V_{h20})\rightarrow(V_{h10}+\Delta V_{h1i}+V_{h20}+\Delta V_{h2i})$, the linear density increment of yarn Y is:

$$\Delta\rho_{yi} = \frac{\rho}{e_q * V_Z} * (\Delta V_{h1i} + \Delta V_{h2i});$$

then the linear density $\rho_{yi}$ of the yarn Y is expressed as $$\rho_{yi} = \rho_{y0} + \Delta\rho_{yi} = \rho_{y0} + \frac{\Delta V_{h1i} + \Delta V_{h2i}}{V_Z} * \frac{\rho}{e_q}; \tag{7}$$

let $\Delta V_1=\Delta V_{h1i}+\Delta V_{h2i}$, then Equation (7) is simplified as:

$$\rho_{yi} = \rho_{y0} + \frac{\Delta V_i}{V_Z} * \frac{\rho}{e_q}; \tag{8}$$

the linear density of yarn Y is adjusted by controlling the sum of the linear speed increments $\Delta V_i$ of the first back roller, the second back roller.

9. The method of claim 8, wherein let $\rho_1=\rho_2=\rho$, at the moment of switching the segment i−1 to the segment i of the yarn Y, the blending ratios of the yarn Y in Equations (2)-(6) are simplified as:

$$k_{1i} = \frac{V_{h10} + \Delta V_{h1i}}{V_Z + \Delta V_i} \tag{9}$$

$$k_{2i} = \frac{V_{h20} + \Delta V_{h2i}}{V_Z + \Delta V_i} \tag{10}$$

the blending ratios of the yarn Y are adjusted by controlling the linear speed increments of the first back roller, the second back roller;

wherein $$\Delta V_{h1i}=k_{1i}*(V_Z+\Delta V_i)-V_{h10}$$

$$\Delta V_{h2i}=k_{2i}*(V_Z+\Delta V_i)-V_{h20}.$$

10. The method of claim 8, wherein let $V_{h1i}*\rho_1+V_{h2i}*\rho_2=H$ and H is a constant, then $\Delta V_i$ is constantly equal to zero, and thus the linear density is unchanged when the blending ratios of the yarn Y are adjusted.

11. The method of claim 8, wherein let any one of $\Delta V_{h1i}$, $\Delta V_{h2i}$ is equal to zero, while the remaining one is not zero, then the one roving yarn ingredients is changed while the other roving yarn ingredients is unchanged; the adjusted blending ratio are:

$$k_{1i} = \frac{V_{h10} + \Delta V_{h1i}}{V_Z + \Delta V_{h1i}}$$

$$k_{2i} = \frac{V_{h20}}{V_Z + \Delta V_{h1i}}$$

or $$k_{1i} = \frac{V_{h10}}{V_Z + \Delta V_{h2i}}$$

$$k_{2i} = \frac{V_{h20} + \Delta V_{h2i}}{V_Z + \Delta V_{h2i}}.$$

12. The method of claim 8, wherein let none of $\Delta V_{h1i}$, $\Delta V_{h2i}$ is equal to zero, then the proportion of the first roving yarn ingredients and the second roving yarn ingredients in the yarn Y is changed; the adjusted the blending ratios are:

$$k_{1i} = \frac{V_{h10} + \Delta V_{h1i}}{V_Z + \Delta V_i}$$

$$k_{2i} = \frac{V_{h20} + \Delta V_{h2i}}{V_Z + \Delta V_i}.$$

13. The method of claim 8, wherein let one of $\Delta V_{h1i}$, $\Delta V_{h2i}$ is equal to zero, while the remaining one is not zero, then the one roving yarn ingredient of the segment i of the yarn Y is discontinuous, thus yarn Y only has one roving ingredient.

14. The method of claim 1, wherein the method is controlled by a control system.

* * * * *